US005769422A

United States Patent [19]

Stromer

[11] Patent Number: 5,769,422

[45] Date of Patent: Jun. 23, 1998

[54] CARD GAME AND APPARATUS

[76] Inventor: Daniel W. Stromer, 500 Gladiola St., Golden, Colo. 80401

[21] Appl. No.: 749,187

[22] Filed: Nov. 14, 1996

[51] Int. Cl.[6] ..... A63F 1/00

[52] U.S. Cl. ..... 273/274; 273/292

[58] Field of Search ..... 273/274, 292, 273/309

[56] References Cited

U.S. PATENT DOCUMENTS

| | | | |
|---|---|---|---|
| 4,836,553 | 6/1989 | Suttle et al. | 273/292 |
| 5,257,789 | 11/1993 | LeVasseur . | |
| 5,275,416 | 1/1994 | Schorr et al. . | |
| 5,294,128 | 3/1994 | Marquez | 273/292 |
| 5,324,041 | 6/1994 | Boylan et al. | 273/309 |
| 5,364,105 | 11/1994 | Jones | 273/292 |
| 5,377,993 | 1/1995 | Josephs . | |
| 5,397,128 | 3/1995 | Hesse et al. | 273/274 |
| 5,411,268 | 5/1995 | Nelson et al. | 273/292 |
| 5,413,353 | 5/1995 | Demarest et al. . | |
| 5,452,900 | 9/1995 | Skratulia et al. . | |
| 5,476,265 | 12/1995 | Miller et al. | 273/292 |
| 5,494,296 | 2/1996 | Grassa . | |
| 5,529,309 | 6/1996 | Bartlett . | |
| 5,538,252 | 7/1996 | Green . | |
| 5,597,162 | 1/1997 | Franklin | 273/292 |

*Primary Examiner*—William M. Pierce
*Attorney, Agent, or Firm*—Townsend and Townsend Crew LLP

[57] ABSTRACT

The invention provides methods and apparatus for playing a Blackjack-type of card game. According to one exemplary method, a banker is selected who then establishes the bank or maximum bet amount. An initial card is then dealt to the player and banker. After receiving the initial card, the player makes an initial wager limited at least by the amount placed in the bank by the banker. A second card is then dealt to the player and banker. At this point the player has the option of standing on the two-card hand or receiving an additional card. When the player decides to stand on a hand and refuses an additional card, the banker then has the option of receiving additional cards. Once the banker chooses to not receive an additional card, the banker's and player's cards are compared in the manner of conventional Blackjack to determine a winning and losing player.

12 Claims, 3 Drawing Sheets

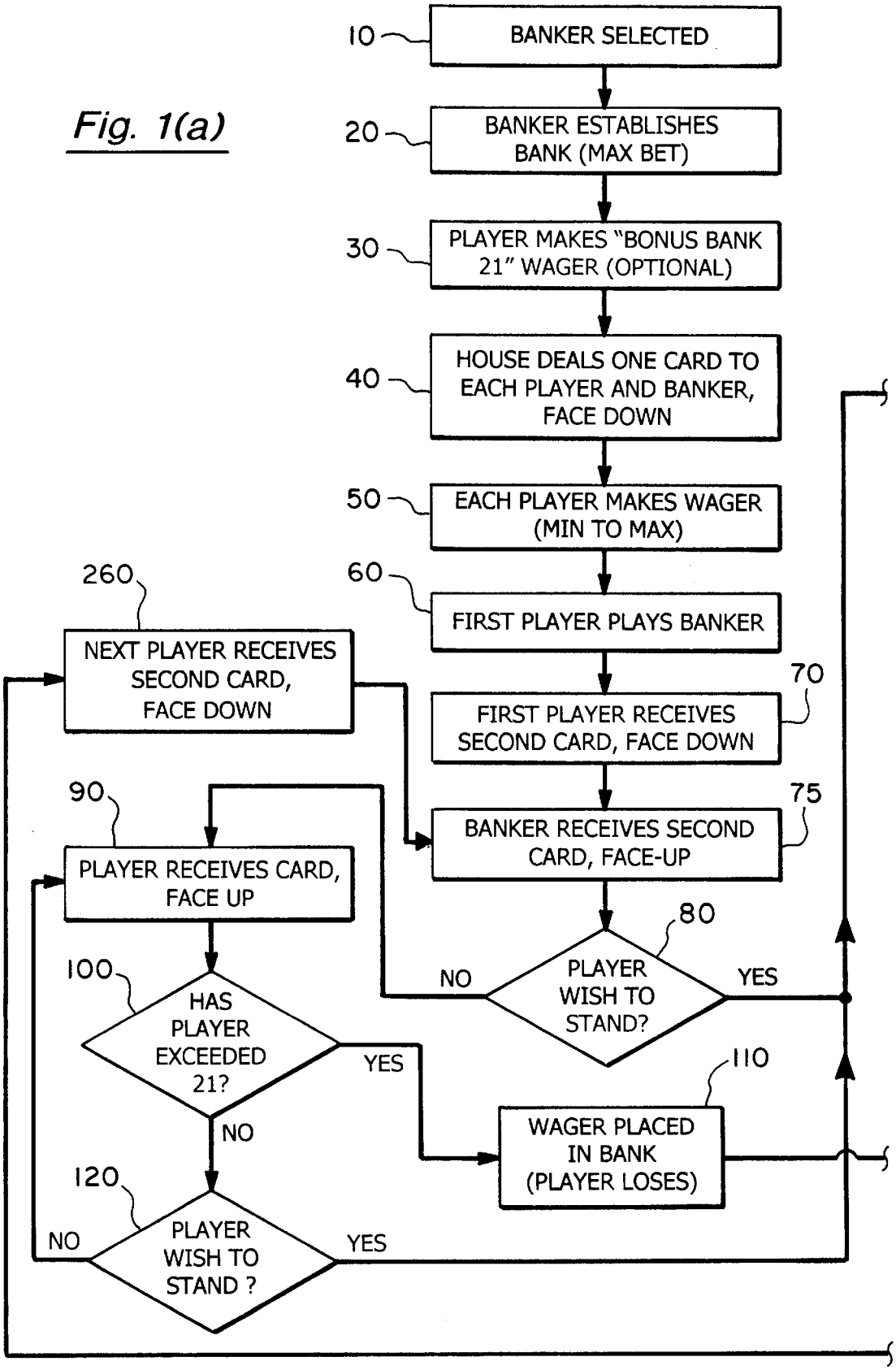
Fig. 1(a)
10
BANKER SELECTED
20
BANKER ESTABLISHES BANK (MAX BET)
30
PLAYER MAKES "BONUS BANK 21" WAGER (OPTIONAL)
40
HOUSE DEALS ONE CARD TO EACH PLAYER AND BANKER, FACE DOWN
50
EACH PLAYER MAKES WAGER (MIN TO MAX)
60
FIRST PLAYER PLAYS BANKER
70
FIRST PLAYER RECEIVES SECOND CARD, FACE DOWN
75
BANKER RECEIVES SECOND CARD, FACE-UP
80
PLAYER WISH TO STAND?
NO
YES
260
NEXT PLAYER RECEIVES SECOND CARD, FACE DOWN
90
PLAYER RECEIVES CARD, FACE UP
100
HAS PLAYER EXCEEDED 21?
YES
NO
110
WAGER PLACED IN BANK (PLAYER LOSES)
120
PLAYER WISH TO STAND ?
NO
YES

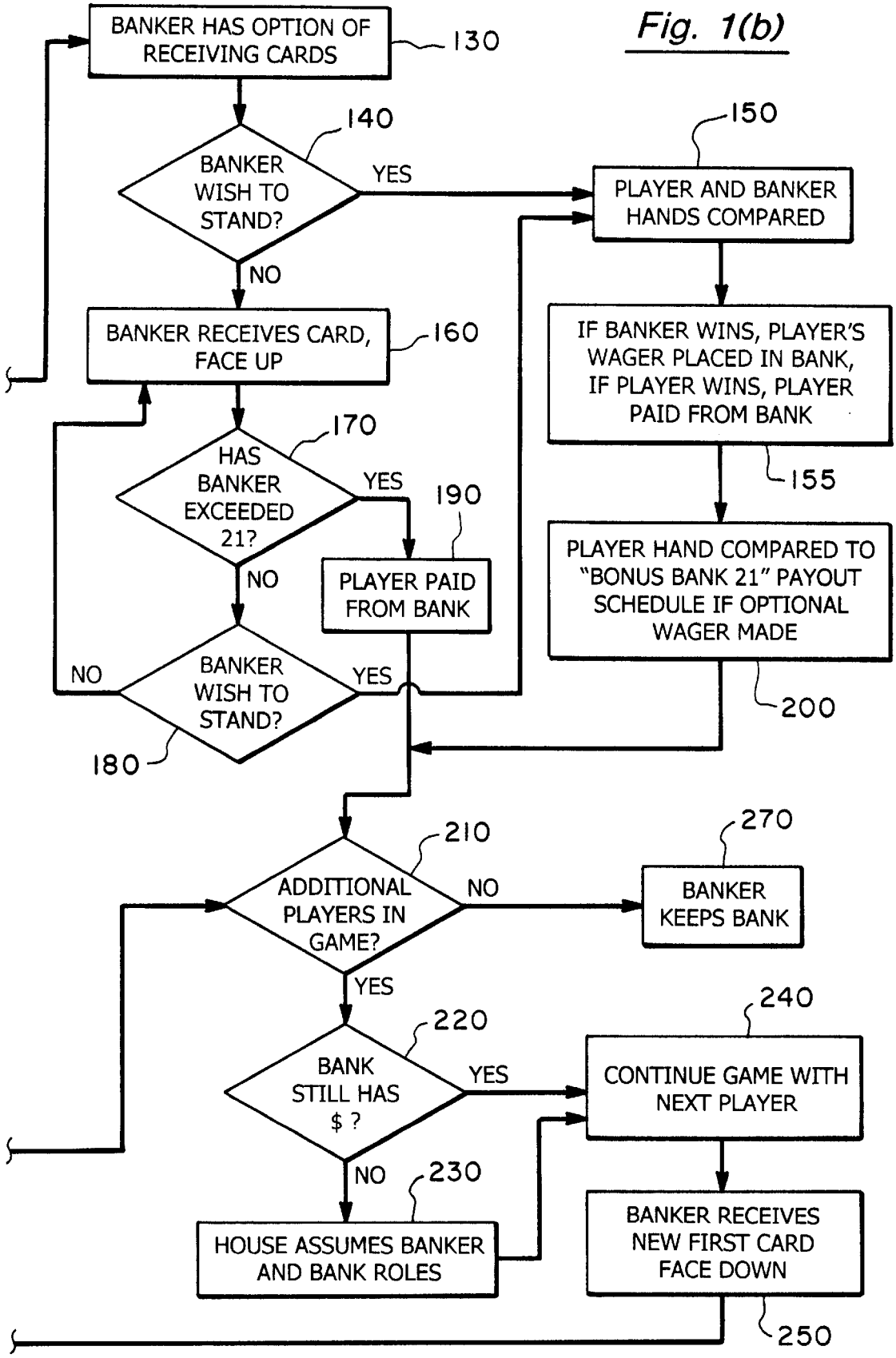
Fig. 1(b)
BANKER HAS OPTION OF RECEIVING CARDS
130
BANKER WISH TO STAND?
140
YES
NO
PLAYER AND BANKER HANDS COMPARED
150
BANKER RECEIVES CARD, FACE UP
160
IF BANKER WINS, PLAYER'S WAGER PLACED IN BANK, IF PLAYER WINS, PLAYER PAID FROM BANK
155
HAS BANKER EXCEEDED 21?
170
YES
190
NO
PLAYER PAID FROM BANK
PLAYER HAND COMPARED TO "BONUS BANK 21" PAYOUT SCHEDULE IF OPTIONAL WAGER MADE
200
NO
BANKER WISH TO STAND?
YES
180
ADDITIONAL PLAYERS IN GAME?
210
NO
270
BANKER KEEPS BANK
YES
BANK STILL HAS $ ?
220
YES
240
CONTINUE GAME WITH NEXT PLAYER
NO
230
HOUSE ASSUMES BANKER AND BANK ROLES
BANKER RECEIVES NEW FIRST CARD FACE DOWN
250

CARD GAME AND APPARATUS

BACKGROUND OF THE INVENTION

The invention relates generally to a Blackjack-type of card game. More particularly the invention relates to a Blackjack-type of card game where the players play against a pre-selected banker who establishes a bank from which pay-outs are made.

The game of Blackjack or Twenty-One is a world renowned card game played in casinos and elsewhere throughout the world. The game of Blackjack typically involves a player or players playing against a single dealer. To win at Blackjack, a player must receive cards whose total card value is higher than that of the dealer but no greater than twenty-one. To play Blackjack, each player and the dealer first receive two initial cards, with each card having a predetermined value. For example, the ten-card and face cards (Jack, Queen and King) each have a value of ten points. Cards numbered two through nine have those corresponding point values. An Ace has a point value of either one or eleven. After receiving the two initial cards, each player has the option of receiving additional cards. Should the player receive an additional card that results in a total card value greater than twenty-one, the player has "busted" and lost the game. The player loses any wager they may have made on the game.

The player also may elect to "stand" on a hand having two or more cards whose point value is equal to or less than twenty-one. At this point, the player receives no additional cards and the dealer then has the option to draw additional cards over and above the two initial cards received. When both the player and the dealer chose to stand and receive no further cards, the point values of the two hands are compared and a winning and losing player is determined.

In a typical casino environment, the dealer's hand is played by the "house." In addition, a predetermined set of house rules typically dictate whether or not the dealer may draw an additional card over and above the two initial cards received. For example, when the dealer hand's has a point total of sixteen or higher, house rules often require that the dealer "stand" on that hand as opposed to drawing a third or subsequent card. Blackjack games played in casinos are typically preceded by each player making an initial wager. When a player beats the dealer, the house typically pays the player an amount equal to the player's initial wager. When the dealer beats a player or the player's cards exceed twenty-one, the house receives the player's initial wager. When the dealer and player have cards totaling the same point total, the hand is often called a "push", and the player retains any amount wagered.

Casinos typically employ a plethora of house rules to govern Blackjack play. For example, if a player receives two initial cards having the same point value, such as two "eights", the player typically has the option of splitting those cards and forming two separate hands. The player would be required to place an initial wager for the second playing hand, and then the player plays both hands against the dealer's one hand. Other house rules may involve a "doubling down" wager. In this situation the player makes a secondary wager after receiving the two initial cards. The player then is allowed to receive only one additional card. Other house rules, such as betting minimums and maximums, may also apply in a typical casino.

Although the game of Blackjack has gained worldwide acceptance, it would be desirable to provide certain improvements. For example, it would be desirable to provide modifications to the game to make the game more exciting and more interesting. In addition it would be desirable to allow more player interaction and the opportunity to win a larger pay-out.

SUMMARY OF THE INVENTION

The present invention provides both methods and apparatus for playing a Blackjack-type of card game where the layers have a chance to play against a preselected banker. In this way, each player has the chance to become the banker, and play against the other players. As a result, the game becomes more exciting and interesting.

In an exemplary method, the invention provides for the playing of a Blackjack-type of card game wherein at least one player plays against a banker and wherein the play is overseen by a house. According to the method, the banker places an initial amount into a bank. All players and the banker are dealt an initial card. After receiving the initial card, each player makes an initial wager limited at least by the initial amount placed into the bank. For example, if the banker places $500.00 into the bank, each player cannot make an initial wager that exceeds $500.00. If the house has established a table maximum of $20.00, then each player is also limited by the table maximum and cannot make an initial wager that exceeds $20.00 even though the banker placed a $500.00 initial amount into the bank. A first one of the players then plays against the banker, and receives a second card. The banker also receives a second card, preferably face-up. The player is then provided with the option of receiving additional cards. The player may draw as many cards as needed or desired, until the player decides to "stand" on the cards received or until the player's cards exceed a point value of twenty-one. When the player chooses to stand, the banker is provided with the option of receiving additional cards until the banker either wishes to stand or exceeds twenty-one. When both the player and banker have chosen to stand on their existing cards, the hands are compared in the conventional manner of Blackjack and a winning and losing player is determined. If more than one player exists, another player plays against the banker in the same manner as the first player.

In one particular aspect of the method, the barker is selected from two or more players. In another aspect, the house occupies the role of banker if none of the players wishes to be the banker.

In another aspect of the method, if the player is the winning player, the player receives a payout from the bank. If the bank contains insufficient funds to pay a winning player, the winning player is paid from a house fund. In this manner, the house pays the winning player and the house retains the bank's insufficient funds. In another aspect, should the bank funds be depleted at any time during the course of the game, the house assumes the role of the banker. In still another aspect of the method, should the banker be the winning player, the player's initial wager is placed into the bank. At the end of the game, after all players have played against the banker, the banker receives any money remaining within the bank. Preferably, the banker has the option to "press", which allows the banker to remain as the banker for one additional round of hands against the players. If the banker "presses", any money remaining within the bank at the end of the first round preferably remains in the bank to start the second round of hands.

In an additional aspect of the method, the banker's initial card is dealt to the banker face down and all subsequent cards are dealt to the banker face up. In a further aspect, the player's initial card is dealt to the player face down.

The method may further include other options such as providing the player the option of splitting cards of the same value to create an additional playing hand. When splitting hands, the player will be required to place an initial wager for the second hand. In this manner, the player plays two hands against the banker's one hand.

In a particular aspect of the method, the player has an option of making a secondary wager before receiving an initial card. The player's secondary wager may be limited by a table minimum or maximum. A player receives a payout for the secondary wager if the player's cards correspond to a predetermined schedule of card combinations. For example, if he player's hand comprises three seven cards of any suit, the payoff on the secondary wager may be fifty to one.

The invention provides one particularly preferable method for playing Blackjack where at least two players play against a banker. According to the method, the banker places an initial amount into a bank. Each player and the banker receive an initial card. Each player then makes an initial wager limited at least by the amount placed in the bank. House betting rules and/or state laws may also limit the amount of the first player's wager. After the initial wager has been made, another card is dealt to a first player. A second card is then dealt to the banker, preferably face-up The first player then has the option of receiving additional cards. Once the first player chooses not to receive an additional card, the banker has the choice of receiving additional cards.

Once both the banker and the first player have elected to stand on their existing cards, the player's cards and banker's cards are compared in the manner of conventional Blackjack to determine a winning and losing player. If the banker is the winning player, the first player's initial wager is placed into the bank. If the first player is the winning player, the first player is paid from the bank.

Once play is completed for the first player, a second player plays against the banker. To begin this process, the banker receives a new initial card. The second player then plays against the banker in the same manner as described for the first player, until a winning and a losing player is determined. Once all players have had the chance to play against the banker, the banker retains any money remaining in the bank. Preferably, the banker has the option to "press" one time in which the money preferably remains in the bank and a second round of hands is played against the players. At the conclusion of the second round of hands, the banker retains any money remaining in the bank.

A further aspect of this method involves the banker being selected from three or more players. An additional aspect of this method involves the house being selected as the banker if none of the players wishes to be the banker.

In a still further aspect of the method, if one of the players is the winning player, the winning player is paid from the bank. If the bank contains insufficient funds to pay a winning player, the winning player is paid from a house fund. If a house fund is needed to pay a winning player, a further aspect of this method involves the house assuming the role of the banker for all subsequent players. In this manner, subsequent players play against the house.

The invention further provides an apparatus for playing a Blackjack-type of card game. The apparatus comprises a table having a playing surface. A house playing station is located at a first position on the playing surface. A plurality of player playing stations are located at spaced positions on the playing surface. Each player playing station has a defined region for making an initial wager and a defined region for making a secondary wager. The apparatus further includes a defined bank region located near the center of the playing surface. This bank region is used for receiving a losing player's wager and for paying a winning player.

In a further aspect of the apparatus, a movable banker button is provided and may be placed adjacent one of the player stations. The banker button is used to designate which player has been selected as the banker. In a preferable aspect, the initial wager regions are generally rectangular in geometry. The secondary wager regions are preferably circular in geometry. The defined bank region is generally rectangular in geometry and is larger than the initial wager regions for each individual player.

BRIEF DESCRIPTION OF THE DRAWINGS

FIG. 1 is a flowchart illustrating an exemplary method for playing a Blackjack-type of card game according to the present invention.

DETAILED DESCRIPTION OF THE SPECIFIC EMBODIMENTS

Figure 2:
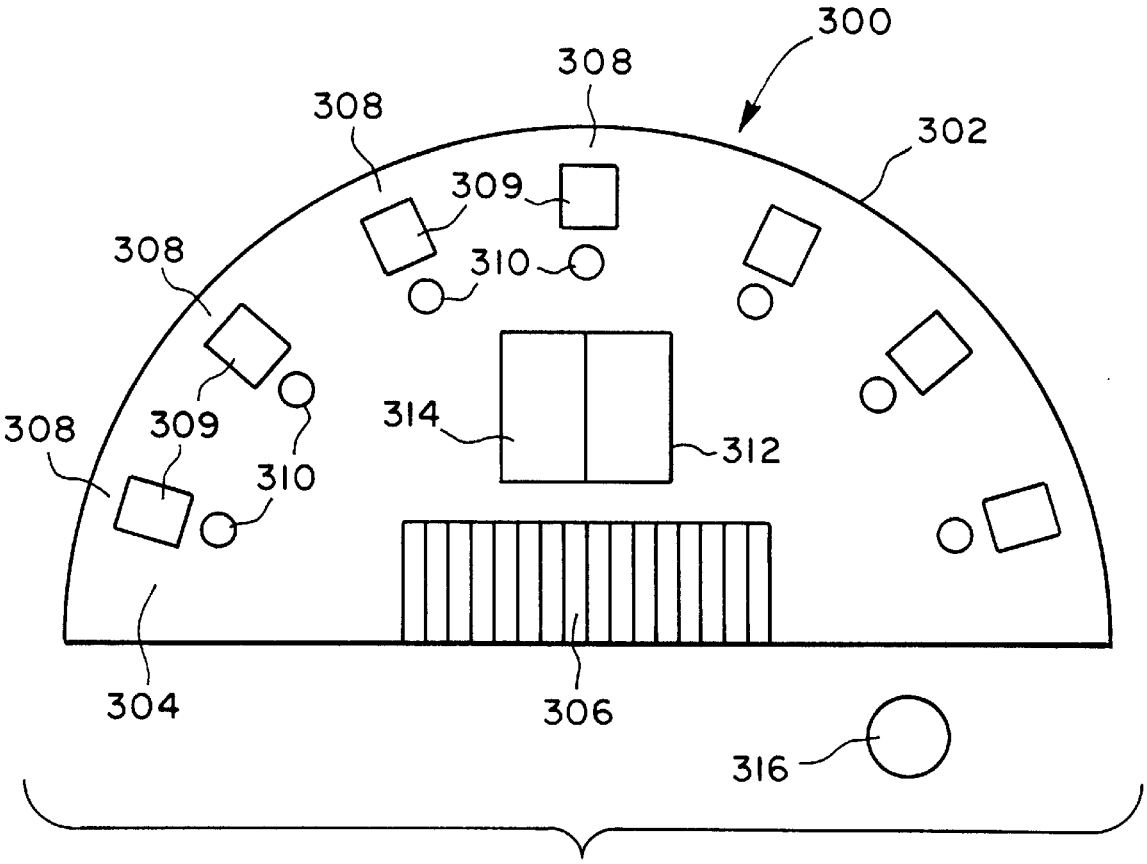
FIG. 2 is a top view of an exemplary card table incorporating a Blackjack-type of card game in accordance with the principles of the present invention.

Referring now to the figures, an exemplary method and apparatus for playing a Blackjack-type of card game will be described. The game will preferably employ a regular deck of fifty-two playing cards, preferably using from one to eight fifty-two card decks. The cards may be dealt from a dealing "shoe" or by hand. The game may involve a single player playing against the banker or, alternatively, a plurality of players each playing against the banker in sequence.

Referring now to FIG. 1, an exemplary method for playing a Blackjack-type of card game will be described. To start the game, a banker is first selected as illustrated in step 10. For example, a first player may be offered the banker role. If the first player declines to be the banker, a second player may be offered the banker role. If necessary, this process continues until a player chooses to be the banker. If no player wishes to be the banker, the house assumes the banker role. In some situations (such as when required by local law), the house or casino will always operate as the banker.

Once a banker has been selected, the banker establishes a bank by placing an initial amount into a bank region as illustrated in step 20. The initial amount placed in the bank establishes a maximum bet limit for each player who plays against that banker. House betting rules and/or state law also may restrict the amount each player can wager.

Once the bank has been established, each player has the option of making a "bonus bank twenty-one" wager as illustrated in step 30. Pay-outs on the "bonus bank twenty-one" wager, also referred to as a "secondary wager", will be described below. After all optional bonus bank twenty-one wagers have been placed, the house deals a single card to each player and the banker face down, as illustrated in step 40.

The house retains responsibility for dealing the cards even if a player has been selected to be the banker. After receiving the first card, each player makes an initial wager as illustrated in step 50. House betting rules and/or state law may restrict the amount each player can wager. In addition each player's initial wager cannot exceed the amount initially placed in the bank by the banker in step 20.

After each player has received an initial card and made an initial wager, the first player plays against the banker as indicated in step 60. The first player receives a second card face down as indicated in step 70 and the banker receives a second card face-up as shown in step 75. At this point, the first player may have the option of splitting or doubling down. Splitting may be allowed when the player's first two cards have the same face value, such as a pair of eights. If the player chooses to split the first two cards, the player essentially creates two hands to play against the banker. The player would be required at this point to place a second initial wager to correspond with the second additional playing hand. Typically, this wager must be the same amount as the initial wager made in step 50. The player may also have the option of "doubling down". In this situation, the player places an additional bet and then is allowed to receive only one additional card. Typically, the additional bet made when "doubling down" must be the same amount as the player's initial wager made in step 50.

Once the first player has received a second card, the player will have to decide whether to stand on that hand or receive an additional card as shown in step 80. If the first player is satisfied with the total card value from the two-card hand, the player "stands" and will not receive any additional cards. The banker will then have the opportunity to receive additional cards. However, if the first player wishes an additional card, the player will be dealt this card face up as shown in step 90.

After receiving an additional card, the player's hand may or may not have exceeded the value of twenty-one, as illustrated by step 100. If the player has exceed twenty-one or "busted", the player loses the initial wager. Such initial wager is placed in the bank as shown in step 110. At this point the player has lost and play continues with a new player playing against the banker. If the player's additional card has not caused the player's hand to exceed twenty-one, the player again must decide whether to stand or take an additional card as shown in step 120. If the player chooses to accept an additional card, the same process as described in steps 90–120 will be repeated. Assuming the player has not exceeded twenty-one, the player will at some point stand on a hand with a point value equal to or less than twenty-one. Then, the banker will have the option of receiving additional cards as shown in step 130.

At this point, the banker must decide whether to stand on this two-card hand or take an additional card as shown in step 140. Unlike conventional Blackjack which at times requires a banker or dealer to stand on a certain card combination, the banker in the present invention is not limited as such. For example, the banker may choose to receive an additional card even when the banker's two-card hand totals seventeen points. Local law may provide restrictions as to when the banker can or cannot receive an additional card.

If the banker chooses to stand, the banker's and player's hands are compared as shown in step 150. If the banker wishes to receive an additional card, the banker is dealt this card face up as shown in step 160. The banker may have exceeded twenty-one by receiving a third card as indicated by step 170. If the banker has exceeded twenty-one, the player will be paid from the bank as shown in step 190. If the banker has not exceeded twenty-one after having received a third card, the banker must decide whether to stand on this three-card hand or receive a fourth card as shown in step 180. If the banker chooses to accept an additional card, the same process as described in steps 160–190 will be repeated.

Once the banker decides to stand on any two or more card hand, the player's and banker's hands are compared as indicated in step 150. In determining whether the banker or player holds the winning hand, traditional Blackjack rules are applied. However, a player receiving the combination of an Ace and a ten-value card, or "Blackjack," receives an even money payout on their wager as opposed to the sometimes applied 3:2 payout on "Blackjack" winning hands. In addition, a player whose first two cards total twenty-one points, or "Blackjack", cannot lose. If the dealer also has a two-card hand totaling twenty-one, the player retains the initial wager. If the dealer's hand has a point total of twenty-one, but contains more than two cards, the player is still the winning player. As indicated in step 155, if the banker is the winning player, the player's initial wager is placed into the bank. If the player is the winning player, the player is paid from the bank.

As illustrated in step 200, the player may receive an additional payout if the player made a "bonus bank twenty-one" wager in step 20. "Bonus bank twenty-one" pay-outs will occur according to a predetermined schedule of card combinations and are paid by the house rather than from the bank. For example, if the player's hand has totalled twenty-one points with a certain card combination, such as three sevens of any suit, a 50:1 or perhaps higher payout on the "bonus bank twenty-one" wager would be made. In the event a player made a "bonus bank twenty-one" wager and then chose to split the two initial cards creating two hands, the "bonus bank twenty-one" wager would apply only to the first hand. Alternatively, the player could choose to place a "bonus bank twenty-one" wager for the newly-created second hand.

The "bonus bank twenty-one" wager can be attached to an electronic metering device to provide a way to increase pay-outs for particular card combinations. For example, a player's hand comprising an ace and two through six cards of any suit results in a six-card hand totaling twenty-one points. This card combination could provide a 1000:1 pay-out on a "bonus bank twenty-one" wager. If the house, over time, retains a significant number of losing "bonus bank twenty-one" wagers, the house can increase this potential pay-out to 1500:1 or more. In this manner, the players have the opportunity to receive a larger payout.

Further, the players who win a "bonus bank twenty-one" wager may qualify to play in a special tournament. The house can select tournament participants based on the top "bonus bank twenty-one" wager pay-outs over a prescribed period of time. For example, the players having the top five "bonus bank twenty-one" pay-outs in a given afternoon would be invited to play in a tournament.

Once the first player and banker hands have concluded, the game continues if additional players have made initial wagers as shown in step 210. If the bank has been depleted of funds at the completion of the first player's hand, the house assumes the roles of both the banker and the bank as shown in steps 220 and 230. The house, having assumed the banker role, continues the game with the next player as shown in step 240. Of course this will not effect the game if the house initially was selected as the banker in step 10. If the bank contains funds at the conclusion of the first player's hand, the same banker continues the game against the next player as illustrated by step 240.

First, the banker is dealt a new first card face down as shown in step 250. At this point the second player receives a second card face down as illustrated in step 260. The banker receives a second card face up as indicated in step 75.

The second player then ostensibly repeats the same process available to the first player regarding standing and drawing of additional cards. The banker also has the option to stand or draw additional cards as it did when playing against the first player.

At the conclusion of the hand pitting a last player against the banker, there may or may not be funds remaining in the bank. If there are funds remaining in the bank at the conclusion of the game, the banker retains these funds as shown in step 270. Preferably, the banker will also have the option of continuing as the banker for a second series of hands played against the players sitting at the table. Should the banker elect this option to "press," the banker must leave all funds in the bank that were in the bank at the conclusion of the first series of hands. Once the second series of hands have been played, the banker must withdraw all remaining funds, if any, remaining in the bank at the end of that second series of hands.

At any time during the game, if paying a winning player results in the bank either becoming empty or having insufficient funds to pay a winning player, the house assumes the role of both the bank and the banker. As noted above, this will be incidental if the house was initially selected to be the banker in step 10.

In the likely event one of the players assumes the role of banker, the house retains responsibility for dealing the cards. The house makes money on the card game by receiving a portion of the amount won by a winning player or banker. If a player has a winning wager, the house will receive a commission, preferably 5%, from the winning player. If, after all players have played, the banker collects money from the bank, the house will receive a commission from the banker. This commission will be a percentage, preferably 5%, of the amount the banker receives in excess of the amount placed in the bank in step 20. The house may also place limits on the amount of commission charged.

Referring now to FIG. 2, an exemplary apparatus 300 for playing the Blackjack-type of card game previously described in connection with FIG. 1 will be described. Apparatus 300 comprises a table 302 having a playing surface 304. On one side of table 302 is a banker playing station 306. On an opposite side of table 302 are a plurality of player playing stations 308. Each player playing station 308 comprises an initial wager region 309 and a secondary wager region 310. The initial wager regions 309 are preferably rectangular in shape whereas the secondary wager regions 310 are preferably circular in geometry. The secondary wager region 310 is used for the optional "bonus bank twenty-one " wager. Each player receives their cards at the corresponding player station 308.

Apparatus 300 further includes a bank region 312 located approximately near the center of the playing surface 304. Bank region 312 is preferably rectangular in geometry and is larger than the initial wager regions 309 for each individual player. A portion of the bank region 312 includes a vault region 314. The vault region 314 receives the banker's initial wager which establishes the "bank" or maximum bet amount for each player. The remaining portion of the bank region 312 is used to receive losing players'initial wagers and to pay the winning players.

As previously described in connection with the method of FIG. 1, players may have the option of occupying the role of banker. To facilitate this playing method, a banker button 316 is used to designate which player holds the position of banker. This movable banker button 316 may be placed near a player's playing region 308 corresponding to the player who has been selected to be the banker.

Although the foregoing invention has been described in some detail by way of illustration and example, it will be obvious that certain changes and modifications may be practiced within the scope of the appended claims.

What is claimed is:

1. A method for playing blackjack wherein at least two players play against a banker, the method comprising:

a) offering the position of banker to at least three players;

b) the banker placing an initial amount into a bank;

c) dealing an initial card to the players;

d) dealing an initial card to the banker;

e) a first player making an initial wager limited at least by said initial amount;

f) dealing another card to said first player;

g) dealing another card to the banker;

h) repeating step f until the player chooses not to receive another card;

i) repeating step g until the banker chooses not to receive another card;

j) evaluating the player's cards and the banker's cards in the manner of conventional blackjack and determining a winning player and a losing player;

k) if said banker is the winning player, placing said initial wager into the bank;

l) if said first player is the winning player paying the first player from the bank;

m) repeating steps d through l with the banker playing a second player;

n) paying the banker any money remaining in the bank after all players have played.

2. A method as in claim 1, wherein said initial card is dealt to the banker face down and wherein all subsequent cards are dealt to the banker face up.

3. A method as in claim 1, wherein said initial card is dealt to the players face down.

4. A method as in claim 1, further comprising providing the players with the option of splitting cards of the same value to create an additional playing hand.

5. A method as in claim 4, further comprising requiring each player who elects to split cards of the same value to match said player's initial wager when creating the additional playing hand.

6. A method as in claim 1, further comprising providing the players with the option of making a secondary wager before receiving an initial card.

7. A method as in claim 6, further comprising paying a payout from a house fund to each player who elects to make said secondary wager if the value of the player's cards correspond to a value on a predetermined schedule of card combinations.

8. A method as in claim 1, further comprising selecting the house to be the banker if none of the players accepts the offer to be the banker.

9. A method as in claim 1, wherein if one of said players is the winning player, paying the winning player from said bank.

10. A method as in claim 9, wherein if one of said players is the winning player, paying the winning player from a house fund if the bank contains insufficient funds to pay the winning player.

11. A method as in claim 10, wherein any subsequent players play against the house upon depletion of the bank.

12. A method as in claim 1, wherein the banker is provided the option of playing all players a second time before the banker is paid any money remaining within the bank.

* * * * *